US011387582B2

(12) United States Patent
Stolze

(10) Patent No.: US 11,387,582 B2
(45) Date of Patent: Jul. 12, 2022

(54) CONTACT INSERT AND SWITCH SPRING

(71) Applicant: WAGO Verwaltungsgesellschaft mbH, Minden (DE)

(72) Inventor: Henry Stolze, Bad Frankenhausen (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/165,292

(22) Filed: Feb. 2, 2021

(65) Prior Publication Data

US 2021/0242614 A1 Aug. 5, 2021

(30) Foreign Application Priority Data

Feb. 3, 2020 (DE) ..... 10 2020 102 605.6

(51) Int. Cl.

*H01R 9/24* (2006.01)
*H01R 4/48* (2006.01)
*H01R 13/11* (2006.01)

(52) U.S. Cl.

CPC ..... *H01R 9/2491* (2013.01); *H01R 4/4809* (2013.01); *H01R 9/2408* (2013.01); *H01R 9/2433* (2013.01); *H01R 9/2458* (2013.01); *H01R 13/112* (2013.01); *H01R 9/2416* (2013.01)

(58) Field of Classification Search

CPC .. H01R 9/2491; H01R 4/4809; H01R 9/2408; H01R 9/2433; H01R 9/2458; H01R 13/112; H01R 9/2416; H01R 4/4818; H01R 13/111

USPC ..... 439/224

See application file for complete search history.

(56) References Cited

U.S. PATENT DOCUMENTS 7,845,969 B2 * 12/2010 Stadler ..... H01R 12/515 439/441
9,276,334 B1 * 3/2016 Daily ..... H01R 9/2491

FOREIGN PATENT DOCUMENTS

DE 10 2013 107 807 B3 1/2015

* cited by examiner

*Primary Examiner* — Oscar C Jimenez
*Assistant Examiner* — Paul D Baillargeon
(74) *Attorney, Agent, or Firm* — Muncy, Geissler, Olds & Lowe, P.C.

(57) ABSTRACT

A contact insert for a connecting terminal, wherein the contact insert has a busbar piece and a clamping spring for clamping an electrical conductor in a conductor insertion direction, wherein the busbar piece and the clamping spring form a clamping point for the electrical conductor to be clamped, and wherein the contact insert has a bushing contact for receiving a contact pin. The longitudinal extension direction of the bushing contact runs essentially perpendicular to the conductor insertion direction from the busbar piece. The bushing contact is designed to receive the contact pin perpendicular to the longitudinal extension direction of the bushing contact and to receive the contact pin in the longitudinal extension direction of the bushing contact.

14 Claims, 9 Drawing Sheets

CONTACT INSERT AND SWITCH SPRING

This nonprovisional application claims priority under 35 U.S.C. § 119(a) to German Patent Application No. 10 2020 102 605.6, which was filed in Germany on Feb. 2, 2020 and which is herein incorporated by reference.

BACKGROUND OF THE INVENTION

Field of the Invention

The present invention relates to a contact insert for a connecting terminal, wherein the contact insert has a busbar piece and a clamping spring for clamping an electrical conductor in a conductor insertion direction, wherein the busbar piece and the clamping spring form a clamping point for the electrical conductor to be clamped, and wherein the contact insert has a bushing contact for receiving a contact pin.

Furthermore, the invention relates to a switch spring with a connecting web for the electrically conductive contacting of two contact inserts of the same type.

Description of the Background Art

DE 10 2013 107 807 B3 discloses an electrical connecting terminal with bushing contacts arranged parallel to one another, one bushing contact having contact arms in each case. Contact pins can be inserted perpendicular to the longitudinal direction of the contact arms. Contact is thus made from the side and not from the longitudinal direction of the contact arms.

Such bushing contacts have the disadvantage that corresponding contact pins can only be inserted into the bushing contacts from one side. Thus, the plug-in direction is limited to a certain direction. Since the conditions differ depending on the area of application, a bushing contact may be required that necessitates a different plug-in direction of the contact pin.

SUMMARY OF THE INVENTION

It is therefore an object of the present invention to provide an improved contact insert and an improved switch spring.

Thus, it is proposed that the longitudinal extension direction of a bushing contact extends substantially perpendicular to the conductor insertion direction from the busbar piece and the bushing contact is formed to receive the contact pin perpendicular to the longitudinal extension direction of the bushing contact and to receive the contact pin in the longitudinal extension direction of the bushing contact.

Substantially perpendicular means in particular that the longitudinal extension direction extends at a 90° angle (starting from a 360° system) to the conductor insertion direction. However, deviations of up to 10° are possible.

The longitudinal extent of the bushing contact is the magnitude in which the bushing contact has its greatest length. Consequently, the longitudinal extension direction is the direction in which the bushing contact extends in its greatest length. A width direction of the bushing contact is perpendicular to the longitudinal extension direction, wherein the dimension of the bushing contact in the longitudinal extension direction is substantially larger than the dimension of the bushing contact in the width direction. Substantially larger means in particular that the longitudinal extension direction is at least twice as great as the width direction of the bushing contact.

The receptacle of the bushing contact can be designed in such a way that a contact pin can be inserted into the bushing contact perpendicular to the longitudinal extension direction of the bushing contact and into the bushing contact in the longitudinal extension direction of the bushing contact. This means that the contact pin can be inserted into the bushing contact both in the vertical direction and in the horizontal direction. The vertical direction corresponds in particular to the longitudinal extension direction of the bushing contact. The horizontal direction is in particular the direction extending perpendicular to the vertical direction. Both during the insertion process in the vertical direction and during the insertion process in the horizontal direction, the contact pin is preferably aligned or oriented predominantly parallel to the longitudinal extension direction of the bushing contact during the insertion process and in the inserted state.

Advantageously, the contact pin can be inserted into the bushing contact in a plurality of insertion directions. Thus, it is conceivable that the contact pin can be inserted into the bushing contact in any direction that runs through a plane spanned by the horizontal insertion direction and vertical insertion direction.

Such a design of the bushing contact allows for contact pins to be inserted into the bushing contact of the contact insert from several possible directions. This means that the contact insert can be used flexibly, i.e. independently of the respective application conditions.

The bushing contact may have two contact arms projecting from the busbar piece in the longitudinal direction of the bushing contact.

The design with two contact arms, which project from the busbar piece in the longitudinal direction of the bushing contact, enables simple but reliable clamping of the contact pin in the bushing contact. The bushing contact is thus designed as a fork contact. In particular, the contact arms are arranged opposite each other. However, it is also conceivable that more than two contact arms form a bushing contact. For example, three contact arms can also be formed to accommodate a contact pin.

The contact arms of the bushing contact can be aligned conically with respect to one another, in particular in a plane extending perpendicular to the longitudinal extension direction of the bushing contact. Furthermore, the contact arms can form a receptacle perpendicular to the longitudinal extension direction of the bushing contact and a receptacle in the longitudinal extension direction of the bushing contact for the contact pin.

It has been shown that the conical alignment of the contact arms enables optimum connection of the contact pin from both the vertical and horizontal directions. A conical alignment of the contact arms means in particular that a respective opposite side edge of the contact arms are aligned towards each other, so that a conical shape of the bushing contact is created. In this case, the distance between the opposing side edges of the contact arms is different. In this way, a horizontal receptacle for the pin contact can be formed in a simple structural manner, which enables a so-called "lateral" insertion of a contact pin oriented predominantly parallel to the longitudinal extension direction in the horizontal direction and simultaneously in the vertical direction.

The busbar piece can have a contact opening for receiving a bridge and/or a switch spring. Furthermore, a bridge can be arranged in the contact opening, with the bridge electrically conductively connecting the contact insert and a second contact insert to one another.

Two contact inserts can be electrically connected to each other via the bridge. This connection does not necessarily have to be made between adjacent contact inserts, but can also be made by omitting an intermediate contact insert or another component.

Two contact inserts can also be electrically conductively connected to each other by means of a switch spring. In contrast to the bridge, the switch spring has an actuating section, wherein the electrically conductive connection between the connected contact inserts is disconnected when force is applied to the actuating section. The force can be applied, for example, by inserting a pin strip with contact pins. Preferably, an electrically insulating section of the pin strip acts on an actuating section of the switch spring.

A conductor insertion contour may project from the busbar piece to guide the electrical conductor.

The conductor insertion contour allows for the electrical conductor to be guided safely to the clamping point. The conductor insertion contour can, for example, be formed in one piece from the busbar piece and bent over into the area of the conductor insertion opening and/or clamping point. However, it is also conceivable that the conductor insertion contour is formed from an insulating material housing which projects into the region of the clamping point and/or the conductor insertion opening. The contour can be designed, for example, as a conductor guide bevel which guides an electrical conductor towards the clamping point.

The busbar piece and the bushing contact can be formed in one piece.

Due to the one-piece design, the contact insert can be manufactured particularly efficiently. Furthermore, the one-piece design improves the current flow between the bushing contact and the busbar piece.

The contact insert can be arranged in a terminal with an insulating material housing, wherein the insulating material housing forms a conductor stop for the electrical conductor to be connected.

The contact insert can be arranged in an insulating material housing. By providing a conductor stop, the electrical conductor cannot be inserted excessively far into the terminal, thus ensuring that the electrical conductor is contacted at its stripped end and is not caught by the clamping spring in the area of its electrical insulation. The probability of incorrectly clamping the electrical conductor in the clamping point can thus be reduced.

In terms of the generic switch spring, it is proposed that a contacting area for contacting the first contact insert and a switching arrangement for contacting the second contact insert are arranged on the connecting web, wherein the switching arrangement has an actuating section and is arranged so as to release the contacting between the switching arrangement and the second contact insert by applying force to the actuating section.

The switch spring makes it possible to connect two contact inserts according to the invention in an electrically conductive manner. It may be necessary to release this connection in certain cases. This may be the case, for example, when a contact pin is inserted into the bushing contact of the conductor connecting terminal. By applying force via a pin strip carrying contact pins to the actuating section of the switch spring, the switching arrangement can be moved away from the respective contact insert, wherein the electrically conductive connection between the contact inserts is interrupted. However, it is also conceivable that the actuating section guides the switching arrangement away from the contact insert by applying force via an actuating tool or an actuating trigger.

The switching arrangement may have a bearing portion for (fixed) bearing on a housing and/or contact insert, wherein the bearing portion extends into the operating portion and wherein a contacting portion for contacting the second contact insert is arranged on the operating portion.

In this way, a switch spring can be provided which can be fixedly integrated into a contact insert arrangement. For example, a plurality of contact inserts can be arranged in a single housing or each in a housing, with the switch spring being fixedly integrated in the housing and/or the contact insert via the bearing section. Fixed means in particular that the bearing section of the switch spring has at most only one degree of freedom, so that it is disposed on the housing and/or the contact insert without changing its position.

At a free end of the bearing section, the bearing section extends into the actuating section. In this transition, the switching arrangement is no longer fixedly mounted to the housing and/or the contact insert, so that there is a pivot point of the switching arrangement in this area.

A contacting section projects from the actuating section and contacts the second contact insert. After force is applied to the actuating section, the switching arrangement is moved about the pivot point so that the second contacting section is guided away from the second contact insert and the electrically conductive connection is interrupted.

At least one tab can be arranged on the actuating section of the switch spring, wherein the tab interacts with a contour of a pin strip in such a way that the contact between the switching arrangement and the second contact insert is released.

This allows for the electrically conductive connection of two contact inserts, which are connected by the switch spring, to be released when the pin strip with contact pins is plugged onto the contact insert. A switch spring is thus provided which automatically releases the contacting of the switching arrangement as soon as a pin strip is plugged onto the contact insert.

The undefined term "a" is to be understood as such and not as a numeral. Thus, it is also conceivable that the contact insert has multiple bushing contacts, for example, two, three or four bushing contacts. Furthermore, it is conceivable that the contact insert has a plurality of busbar pieces and clamping springs, forming a plurality of clamping points for electrical conductors. For example, it is conceivable that the contact insert has two busbar pieces and two clamping springs, wherein two clamping points for electrical conductors to be clamped are also formed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
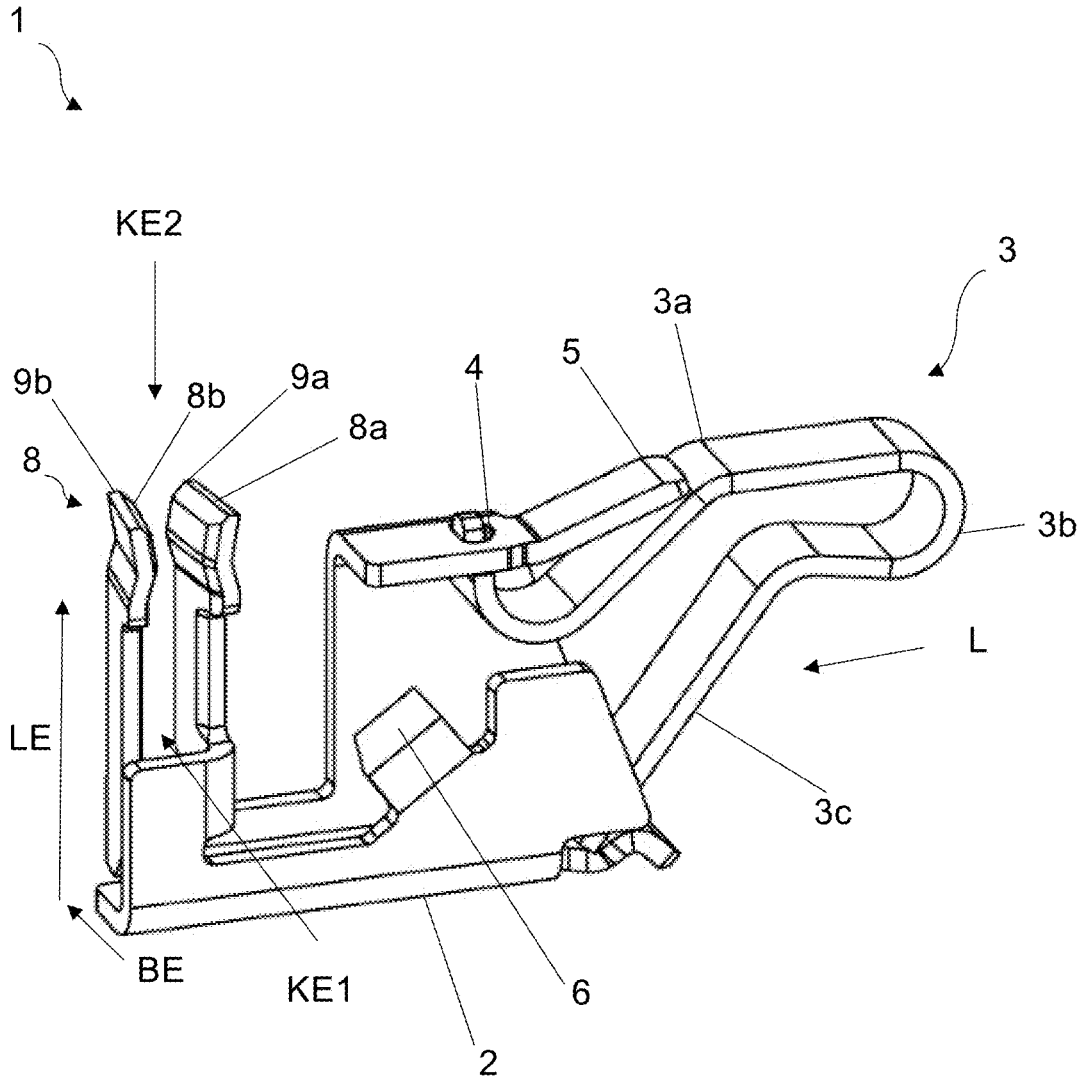
FIG. 1 shows an exemplary embodiment of a contact insert with clamping spring in a perspective view.
Figure 2:
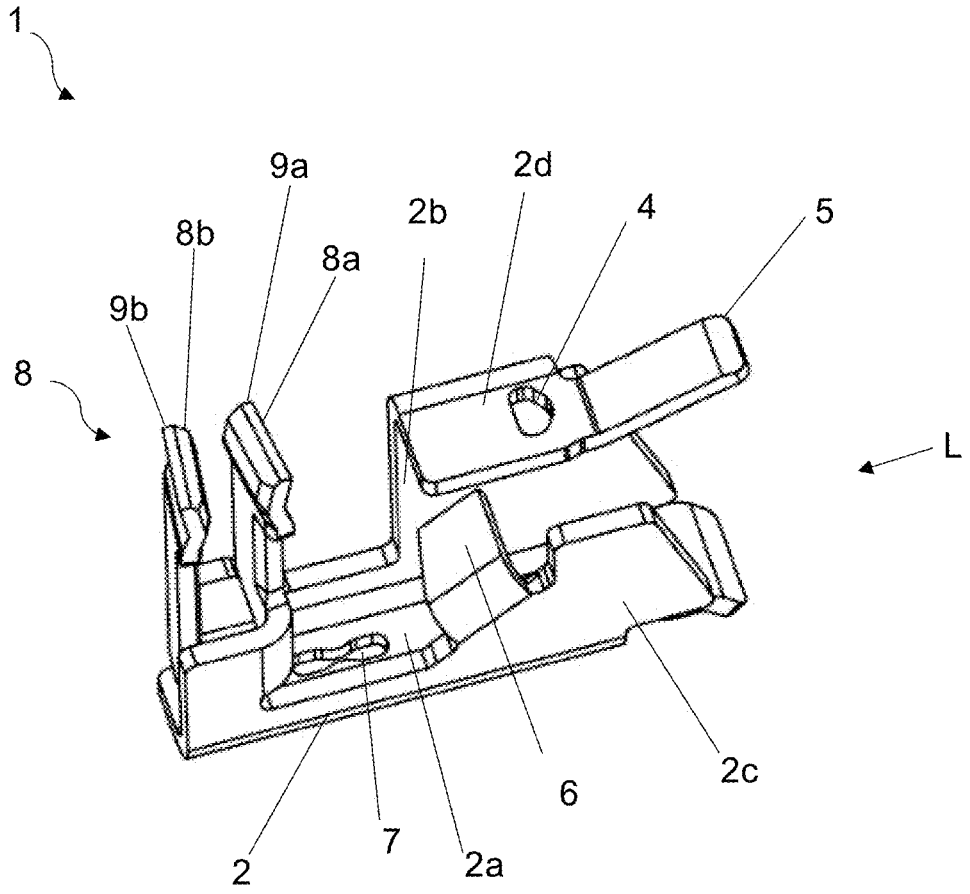
FIG. 2 shows a contact insert according to FIG. 1 without clamping spring in a perspective view.

FIG. 1 shows a perspective view of a contact insert 1 with a busbar piece 2 and a clamping spring 3. FIG. 2 shows the same contact insert 1 without clamping spring. The clamping spring 3 has an abutment leg 3*a* for abutment against the busbar piece 2, wherein the abutment leg 3*a* merges into a spring arc 3*b* which extends into a clamping leg 3*c*. The clamping leg 3*c* and the busbar piece 2 thereby form a clamping point for clamping an electrical conductor in a conductor insertion direction L. The contact leg 3*a* is thereby suspended in a recess 4 of the busbar piece 2, wherein a support section 5 of the busbar piece 2 additionally supports the abutment leg 3*a* and the clamping spring 3 is thus held on the busbar piece 2 by the spring forces. The abutment leg 3*a* extends from the support section 5 in an arc to the recess 4, thereby allowing the clamping spring 3 to be mounted on the busbar rail section 2 in a self-supporting manner.

A conductor insertion contour 6 is arranged on the busbar piece 2, which is formed in one piece from the busbar piece 2 and is bent over in the direction of the clamping point area. The conductor insertion contour 6 is designed as a conductor guide bevel, so that an electrical conductor meets the conductor guide bevel in the conductor insertion direction L and is thus guided towards the clamping point. However, it is also conceivable that the conductor insertion contour 6 is formed by a section of a separate housing, for example.

The busbar piece 2 has a contact opening 7, wherein the contact opening 7 is designed to accommodate a bridge and/or a switch spring. The contact opening 7 is arranged on the underside of the busbar piece 2. The underside is the side to which the electrical conductor to be clamped is clamped to the busbar piece 2 by the clamping spring 3. A first side wall 2*b* and a second side wall 2*c* are bent laterally from the underside of the bus bar piece, or from a contact wall 2*a*, on two opposite sides parallel to the conductor insertion direction L. At the first side wall 2*b*, opposite the contact wall 2*a*, a ceiling wall 2*d* with the recess 4 is bent, wherein the support section 5 extends from the ceiling wall 2*d* against the conductor insertion direction L. In the illustrated embodiment, the conductor insertion contour 6 is connected to the second side wall 2*c*.

It is clear that a bushing contact 8 for a contact pin to be connected projects from the busbar piece 2. The longitudinal extension direction LE of the bushing contact 8 is essentially perpendicular to the conductor insertion direction L. Essentially perpendicular means in particular that the bushing contact 8 projects from the busbar piece 2 at a 90° angle. However, it is also conceivable that the angle deviates by 10° from a 90° angle.

The bushing contact 8 is formed by two opposing contact arms 8*a*, 8*b*. The contact arms 8*a*, 8*b* thus form a fork contact. The contact arms 8*a*, 8*b* are each bent from the opposing side walls 2*b*, 2*c*. The first contact arm 8*a* is bent from the second side wall 2*c* and the second contact arm 8*b* is bent from the first side wall 2*b*.

It is clear that two of the opposing side edges 9*a*, 9*b* of the contact arms 8*a*, 8*b* are aligned with each other so that the contact arms 8*a*, 8*b* are conically aligned with each other. In this way, it is possible to insert a contact pin into the bushing contact 8 in a first contact pin insertion direction KE1, which is aligned perpendicular to the conductor insertion direction L and perpendicular to the longitudinal extension direction LE of the bushing contact. The contact pin can be aligned parallel to the longitudinal extension direction LE, for example.

In this way, the contact pin can be inserted into the bushing contact 8 from two different directions, namely in the first contact pin insertion direction KE1 and a second contact pin insertion direction KE2. The second contact pin insertion direction KE2 runs in the direction of the longitudinal extension direction LE of the bushing contact 8 and perpendicular to the conductor insertion direction L. This enables flexible use of the contact insert 1. The contact pin insertion direction KE1, KE2 of the contact pin can thus be aligned both horizontally and vertically with respect to the bushing contact 8, wherein the vertical second contact pin insertion direction KE2 is in the opposite direction to the longitudinal extension direction LE of the bushing contact 8 and the horizontal first contact pin insertion direction KE1 is perpendicular to the longitudinal extension direction LE of the bushing contact 8.

It is clear that the dimension of the bushing contact 8 in the longitudinal direction LE is considerably greater than the dimension of the bushing contact 8 in the width direction BE of the bushing contact 8. The width direction BE runs perpendicular to the conductor insertion direction L in this case.

It can further be seen that the contact arms 8*a*, 8*b* are integrally formed from the busbar piece 2.

Figure 2A:
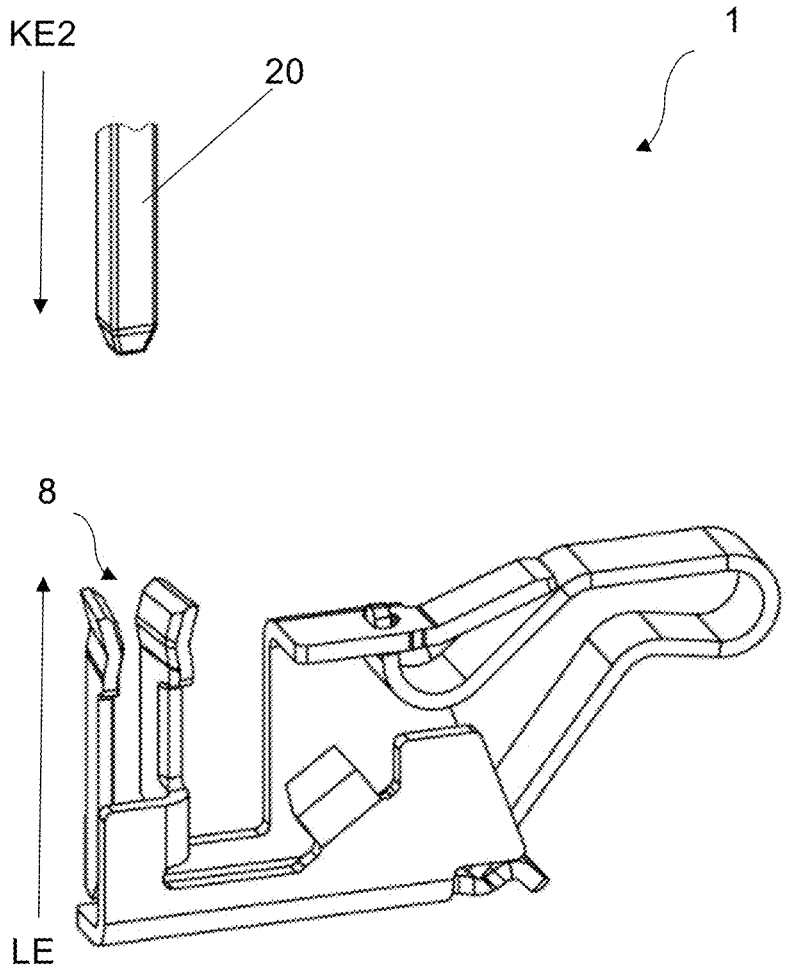
FIGS. 2*a*-2*c* show a contact insert according to FIGS. 1 and 2 with a contact pin in a pre-assembly position.
Figure 2B:
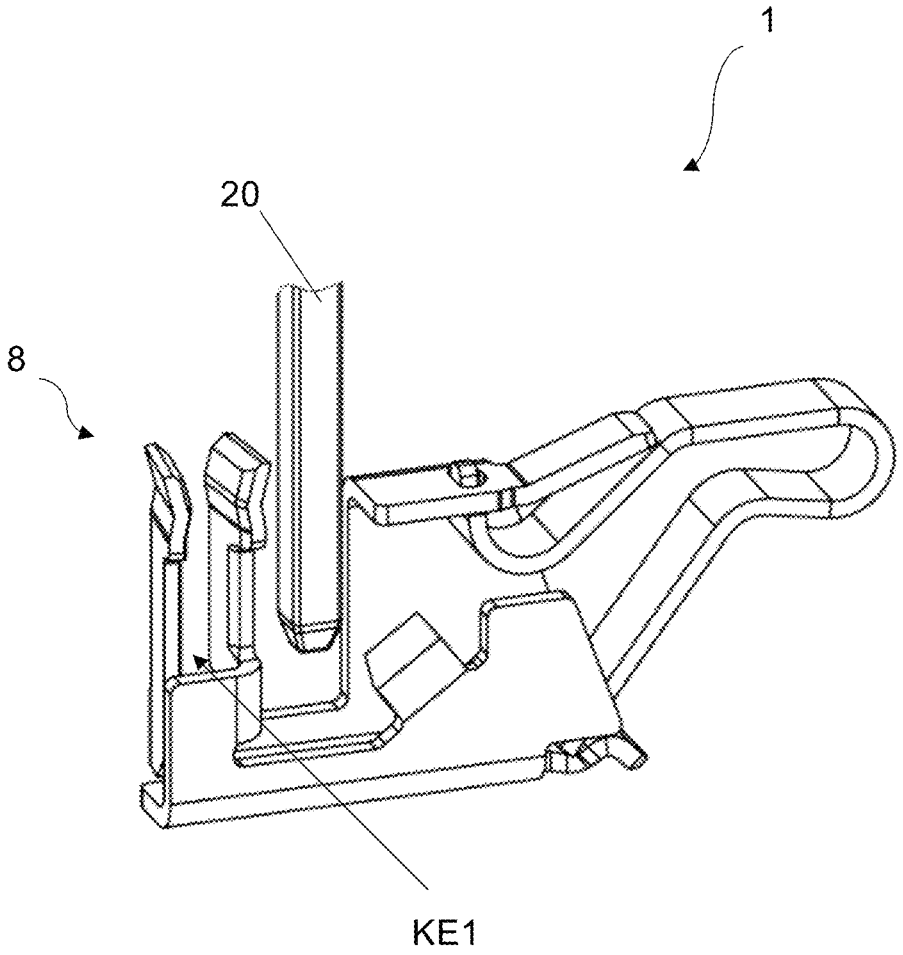
Figure 2C:
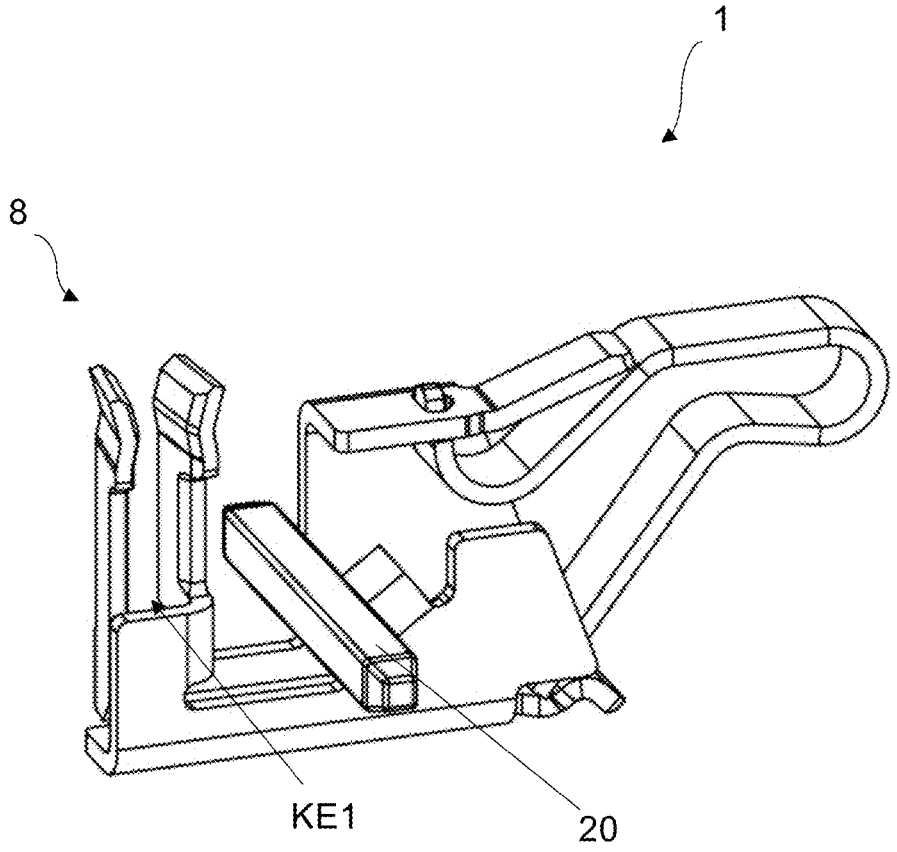

FIGS. 2*a* to 2*c* each show a contact insert 1 according to FIGS. 1 and 2 with a contact pin 20 in a pre-assembly position. The pre-assembly position is the position in which the contact pin 20 is located shortly before it is inserted into the bushing contact 8.

FIG. 2*a* clearly shows that the contact pin 20 can be inserted into the bushing contact 8 in the second contact pin insertion direction KE2 vertically to the longitudinal extension direction LE of the bushing contact 8. The contact pin 20 is aligned parallel to the longitudinal extension direction LE of the bushing contact 8.

FIG. 2*b* clearly shows that the contact pin 20 can be inserted into the bushing contact 8 in the first contact pin insertion direction KE1 horizontally to the longitudinal extension direction LE of the bushing contact 8. The contact pin 20 is aligned parallel to the longitudinal extension direction LE of the bushing contact 8 and can be inserted laterally into the bushing contact 8.

FIG. 2*c* clearly shows that the contact pin 20 can be inserted into the bushing contact 8 in the first contact pin insertion direction KE1 horizontally to the longitudinal extension direction LE of the bushing contact 8, as in FIG. 2*b*. However, in contrast to FIG. 2*b*, the contact pin 20 is not aligned parallel to the longitudinal extension direction LE of the bushing contact 8. The contact pin 20 runs perpendicular to the longitudinal extension direction of the bushing contact 8.

Figure 3:
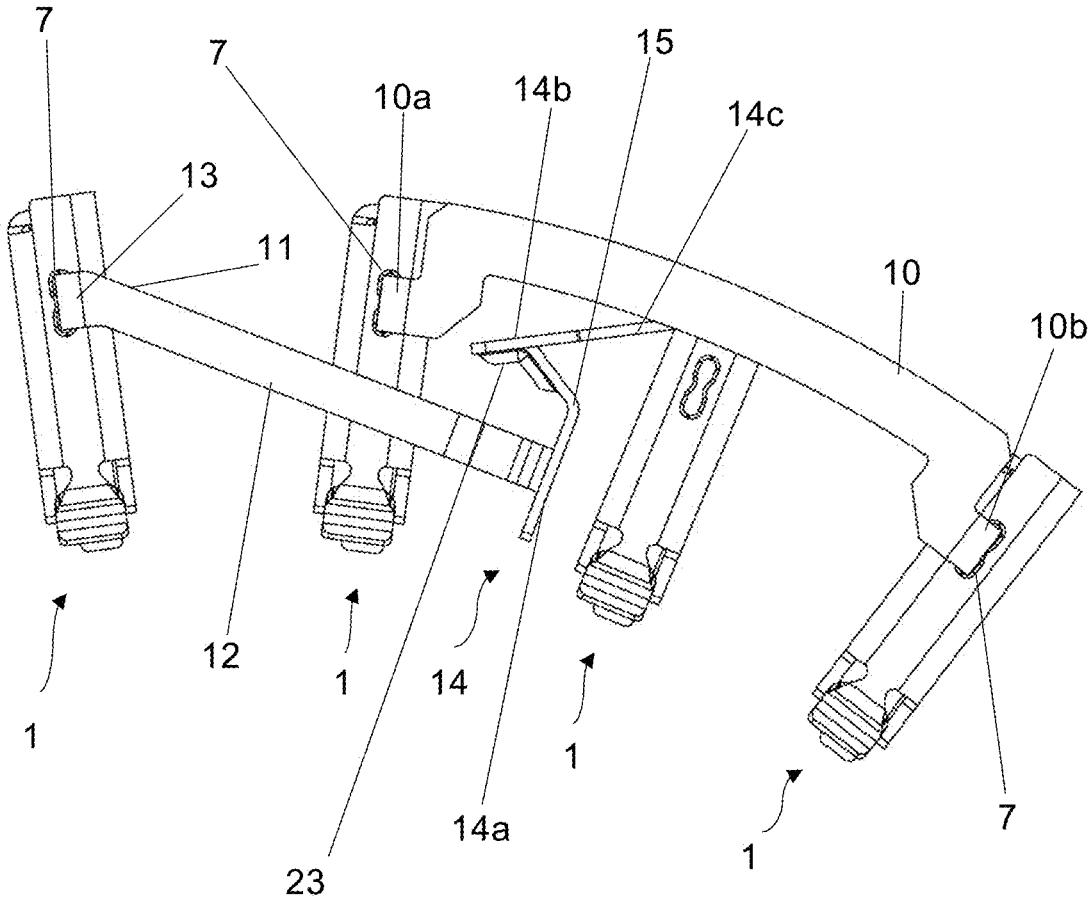
FIG. 3 shows a plurality of contact inserts with a bridge and a switch spring in a bottom view.

FIG. 3 shows a bottom view of a plurality of contact inserts 1 with a bridge 10 and a switch spring 11. The bridge 10 is designed to electrically connect two contact inserts 1 to each other. The contact inserts 1 to be connected do not have to be arranged directly next to each other. This is also possible if another contact insert 1 or another component is arranged between the contact inserts 1 to be connected. The bridge 10 engages with its free ends 10*a*, 10*b* in the contact openings 7 of the respective contact inserts 1 so that the contact inserts 1 are electrically conductively connected to each other.

The switch spring 11 has a connecting web 12, wherein a contacting area 13 for contacting a first contact insert 1 is disposed at one end of the connecting web 12, wherein the contacting area 13 is mounted in the contact opening 7 of the respective contact insert 1. A switching arrangement 14 is disposed at the end of the connecting web 12 opposite the contacting area.

The switching arrangement 14 has a bearing section 14*a* which extends into an actuating section 14*b*, wherein a contacting section 14*c* projects from the actuating section in the direction of the contact insert 1 to be contacted. The contacting section 14*c* thereby abuts against the contact insert 1 to be contacted and establishes an electrically conductive connection between two contact inserts 1. It is clear that when force is applied to the actuating section 14*b*, the switching arrangement is moved about a pivot point 15 in such a way that the contacting section 14*c* is guided away from the contact insert 1 so that the electrically conductive connection is released.

It is further clear that a tab 23 is arranged on the actuating section 14*b* of the switch spring 11, wherein the tab 23 interacts with a contour of a pin strip in such a way that the contact between the switching arrangement 14 and the second contact insert 1 is released.

This allows for the electrically conductive connection of two contact inserts 1, which are connected by the switch spring 11, to be released when the pin strip with contact pins is plugged onto the contact insert 1. Thus, a switch spring 11 is provided which automatically releases the contacting of the switching arrangement 14 as soon as a pin strip is plugged onto the contact insert 1. It is also conceivable that a plurality of tabs 23 may be arranged on the actuating section 14*b* of the switch spring 11.

Figure 4:
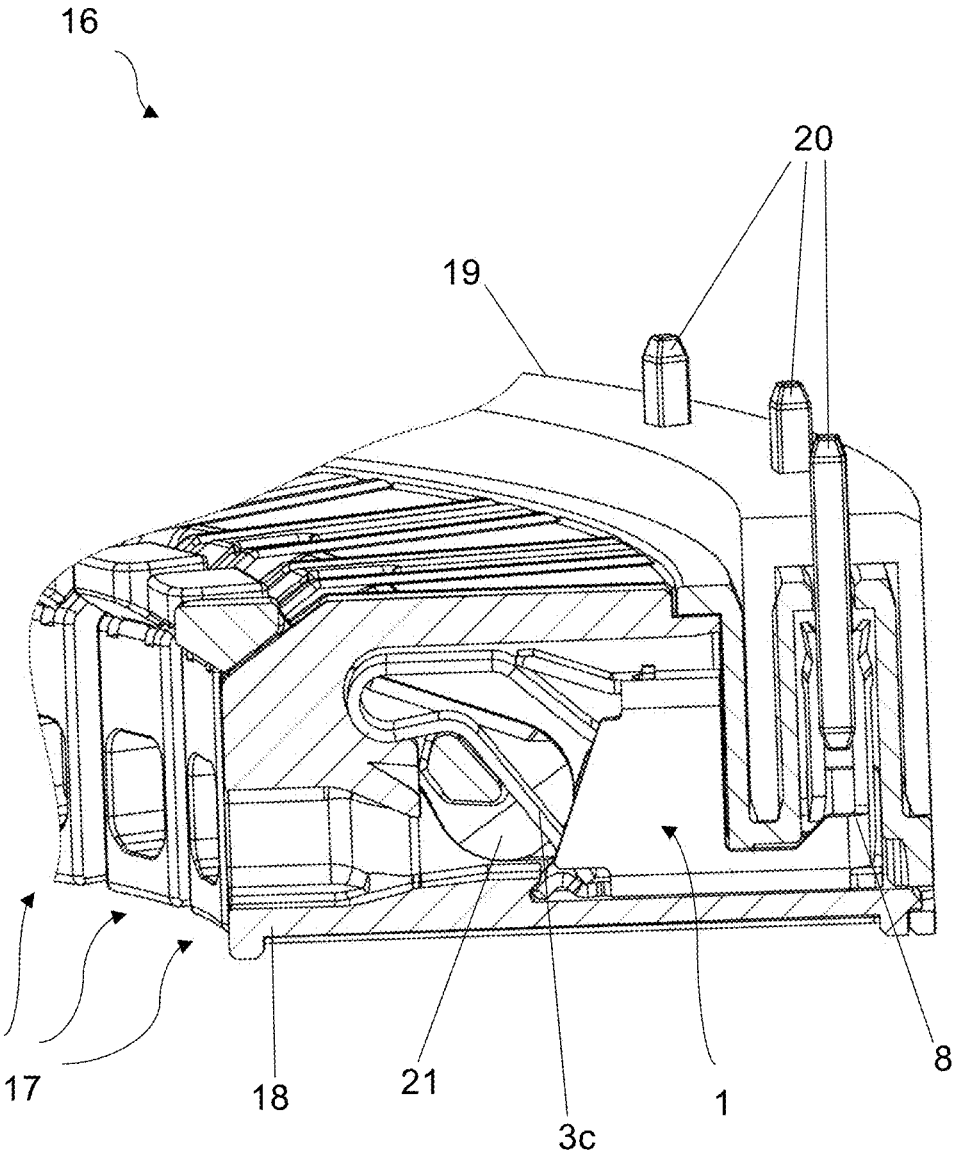
FIG. 4 shows a connecting terminal with a housing and a contact insert according to FIGS. 1 and 2.

FIG. 4 shows a connecting terminal 16 which is formed from a plurality of conductor connection modules 17, wherein the conductor connection modules 17 each have an insulating material housing 18. A contact insert 1 according to the invention is mounted in each insulating material housing 18. A pin strip 19 is plugged into the conductor connection modules 17, wherein the pin strip has contact pins 20. The contact pins 20 engage in the bushing contacts 8 of the contact insert and are aligned predominantly parallel to the longitudinal extension direction LE of the bushing contact 8. An operating lever 21 is arranged on the insulating material housing 18, which interacts with the clamping leg 3*c* to open and/or close the clamping point for the electrical conductor to be clamped.

Figure 5:
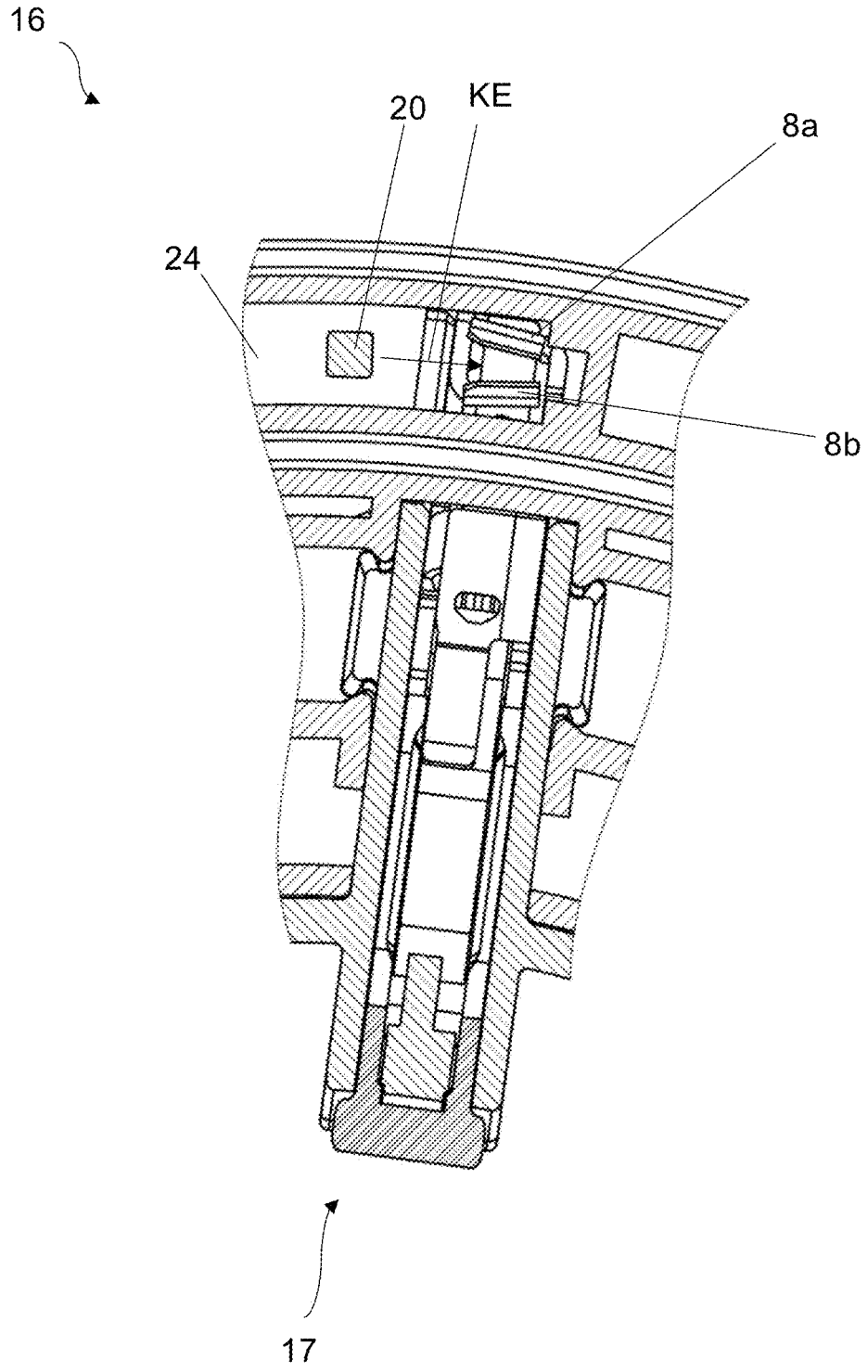
FIG. 5 shows a terminal element with a contact insert in a sectional plan view.

FIG. 5 shows a conductor connection module 17 of a connecting terminal 16 in a sectional plan view. It is clear that the contact arms 8*a*, 8*b* of the bushing contact 8 are conically aligned with each other. They form a trapezoidal shape in the plan view. It can be seen that a contact pin 20 can be received in the bushing contact both horizontally, by pivoting in from the side, and vertically, by insertion from above.

In the embodiment of FIG. 5, the contact pin 20 is arranged in an arc-shaped receiving space 24 in front of the bushing contact 8. The contact pin 20 is in a pre-assembly position. The pre-assembly position is the position in which the contact pin is located shortly before insertion into the bushing contact 8. In the pre-assembly position shown, the contact pin can be inserted horizontally in the first contact pin insertion direction KE1, i.e. laterally to the bushing contact 8.

Figure 6:
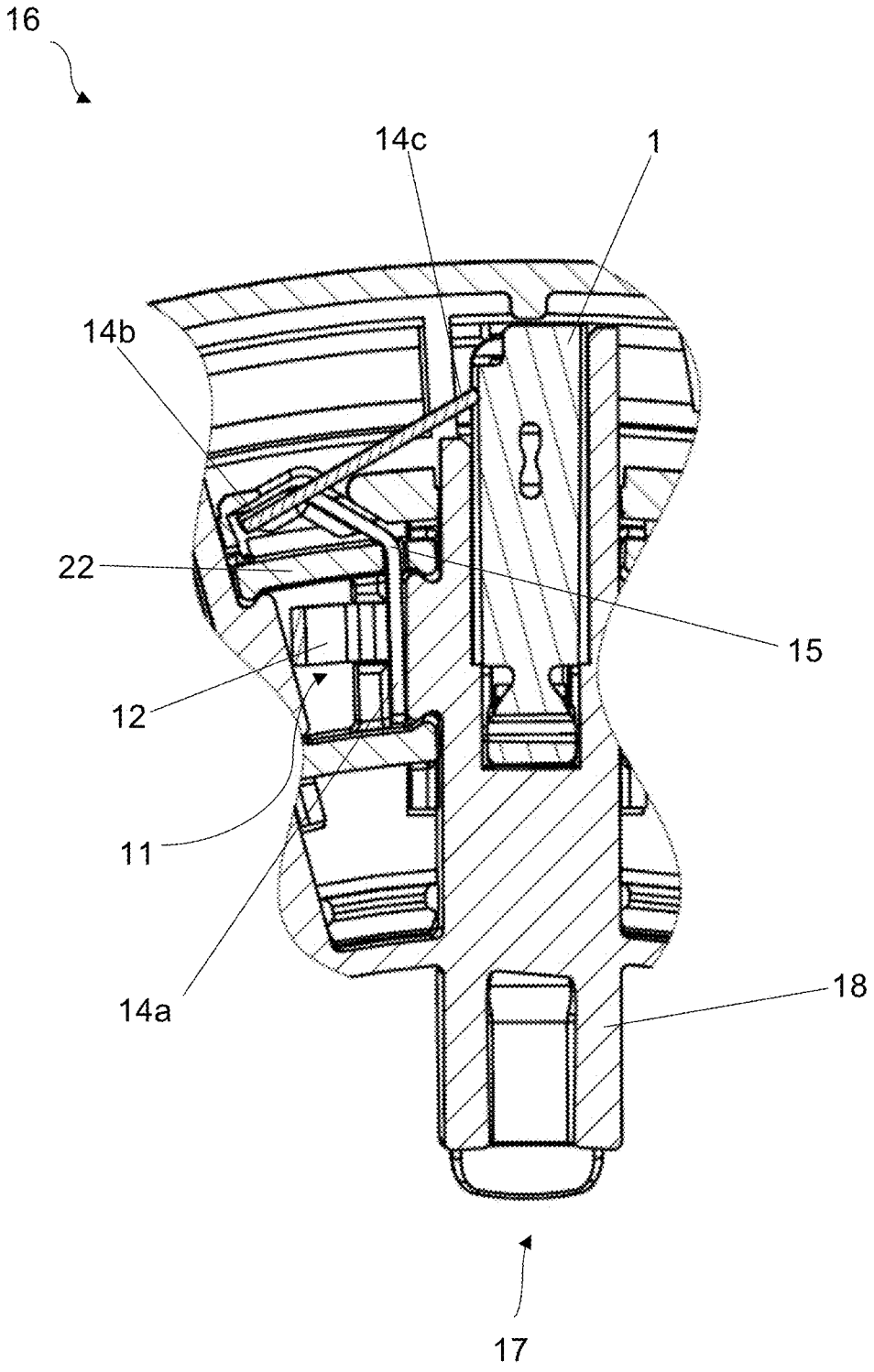
FIG. 6 shows—a bottom view of a contact insert in a housing with a switch spring.

FIG. 6 shows a bottom view of a contact insert 1 in an insulating material housing 18 of a conductor connection module 17 of a connecting terminal 16 with a switch spring 11, which is of the same design as the switch spring in FIG. 3.

It is clear that the switching arrangement 14 is fixedly supported by the bearing section 14*a* on the insulating material housing 18 and on the housing 22 of the connecting terminal, so that when force is applied to the actuating section 14*b*, the switching arrangement is moved about the pivot point 15 so that the contacting section 14*c* is guided away from the contact insert 1, thereby releasing the electrically conductive connection. Thus, after the transition, i.e. at the pivot point 15, of the bearing section 14*a* into the actuating section 14*b*, the switching arrangement 14 is free in space so that the switching arrangement 14 can be moved about the pivot point 15. The switching arrangement can be electrically conductively connected to a further contact insert 1 via the connecting web 12.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A contact insert for a connecting terminal, the contact insert comprising:

a busbar piece; and a clamping spring to clamp an electrical conductor in a conductor insertion direction, wherein the busbar piece and the clamping spring form a clamping point for the electrical conductor to be clamped, wherein the contact insert has a bushing contact for receiving a contact pin, wherein a longitudinal extension direction of the bushing contact runs essentially perpendicular to the conductor insertion direction of the busbar piece, and wherein the bushing contact is adapted to receive the contact pin in a direction substantially perpendicular to the longitudinal extension direction of the bushing contact and adapted to receive the contact pin in the longitudinal extension direction of the bushing contact, wherein the direction substantially perpendicular to the longitudinal extension direction of the bushing contact is perpendicular to the conductor insertion direction.

2. The contact insert according to claim 1, wherein the bushing contact has two contact arms that project from the busbar piece in the longitudinal extension direction of the bushing contact.

3. The contact insert according to claim 2, wherein the contact arms of the bushing contact are oriented conically with respect to one another in a plane extending substantially perpendicular to the longitudinal extension direction of the bushing contact.

4. The contact insert according to claim 3, wherein the contact arms form a receptacle substantially perpendicular to the longitudinal extension direction of the bushing contact and a receptacle in the longitudinal extension direction of the bushing contact for the contact pin.

5. The contact insert according to claim 1, wherein the busbar piece has a contact opening for receiving a bridge and/or a switch spring.

6. The contact insert according to claim 5, wherein the bridge is arranged in the contact opening, and wherein the bridge electrically conductively connects the contact insert and a second contact insert.

7. The contact insert according to claim 1, wherein a conductor insertion contour for guiding the electrical conductor projects from the busbar piece.

8. The contact insert according to claim 1, wherein the busbar piece and the bushing contact are formed in one piece.

9. A connecting terminal comprising:

an insulating material housing; and the contact insert according to claim 1, wherein the insulating material housing forms a conductor stop for the electrical conductor to be connected.

10. The switch spring according to claim 1, wherein the clamping spring has a contact leg and a clamping leg with a spring arc connected between the contact leg and the clamping leg, wherein a distal end of the contact leg is inserted into a recess of the busbar piece and wherein a support section of the busbar piece abuts the contact leg at a position between the distal end of the contact leg and the spring arc.

11. The contact insert according to claim 1, wherein in the direction substantially perpendicular to the longitudinal extension direction of the bushing contact, the bushing contact is adapted to receive the contact pin when the contact pin is aligned parallel to the longitudinal extension direction of the bushing contact and when the contact pin extends perpendicular to the longitudinal extension direction of the bushing contact.

12. A switch spring comprising:

a connecting web for electrically conductive contacting a first contact insert and a second contact insert;

a contacting area for contacting the first contact insert; and a switching arrangement for contacting the second contact insert, the contacting area and the switching arrangement being arranged on the connecting web, wherein the switching arrangement has an actuating section and is arranged to release the contacting between the switching arrangement and the second contact insert by applying force to the actuating section, wherein each of the first contact insert and the second contact insert comprise:

a busbar piece, and a clamping spring to clamp an electrical conductor in a conductor insertion direction, wherein the busbar piece and the clamping spring form a clamping point for the electrical conductor to be clamped, wherein the contact insert has a bushing contact for receiving a contact pin, wherein a longitudinal extension direction of the bushing contact runs essentially perpendicular to the conductor insertion direction of the busbar piece, and wherein the bushing contact is adapted to receive the contact pin substantially perpendicular to the longitudinal extension direction of the bushing contact and adapted to receive the contact pin in the longitudinal extension direction of the bushing contact.

13. The switch spring according to claim 12, wherein the switching arrangement has a bearing portion for bearing on a housing and/or the first contact insert, wherein the bearing portion extends into an operating portion and wherein a contacting portion for contacting the second contact insert is arranged on the operating portion.

14. The switch spring according to claim 12, wherein at least one tab is arranged on the actuating section, wherein the at least one tab interacts with a contour of a pin strip such that the contact between the switching arrangement and the second contact insert is released.

* * * * *